US005941244A

United States Patent [19]

Yamazaki et al.

[11] Patent Number: 5,941,244

[45] Date of Patent: Aug. 24, 1999

[54] DUSTPROOF MASK

[75] Inventors: Tomohiro Yamazaki; Minako Yamazaki, both of Nagano; Machiko Ishizaka, Yokohama, all of Japan

[73] Assignee: Mitsumasa CHINO, Nagano, Japan

[21] Appl. No.: 09/123,820

[22] Filed: Jul. 28, 1998

[30] Foreign Application Priority Data

Jul. 29, 1997 [JP] Japan ..... 9-203211

[51] Int. Cl.[6] ..... A62B 7/10; A62B 7/00

[52] U.S. Cl. ..... 128/206.19; 128/206.12; 128/206.15

[58] Field of Search ..... 128/206.12, 206.13, 128/206.15–206.17, 206.19, 206.24, 206.29

[56] References Cited

U.S. PATENT DOCUMENTS

| | | | |
|---|---|---|---|
| 1,925,764 | 9/1933 | Le Duc | 128/206.12 |
| 2,111,995 | 3/1938 | Schwartz | 128/206.17 |
| 2,174,370 | 9/1939 | Schwatz | 128/206.19 |
| 2,228,218 | 1/1941 | Schwartz | 128/206.19 |
| 2,284,949 | 6/1942 | Cover | 128/206.19 |
| 3,724,174 | 4/1973 | Walkenhorst | 128/206.12 |
| 5,706,804 | 1/1998 | Baumann et al. | 128/206.12 |

FOREIGN PATENT DOCUMENTS

| | | | |
|---|---|---|---|
| 150945 | 9/1920 | United Kingdom | 128/206.19 |

*Primary Examiner*—Kimberly L. Asher
*Attorney, Agent, or Firm*—Flynn, Thiel, Boutell & Tanis, P.C.

[57] ABSTRACT

A dustproof mask comprises a filter unit disposed inside a mask cover. The filter unit is provided with a baggy filter having an inhalation hole in a position corresponding to a mouth of a user. A boundary plate disposed adjacent the filter unit has vent holes opposing the inhalation hole. The user can only take in clean open air through the filter when the user inhales open air through the mouth and the user can only exhale inner air through the nostrils.

16 Claims, 3 Drawing Sheets

DUSTPROOF MASK

BACKGROUND OF THE INVENTION

1. Field of the Invention

The present invention relates to a dustproof mask which is worn on a user's face for protecting the user from allergen such as natural dust, industrial dust, pollen, ticks, microorganism.

2. Prior Art

People fall ill from diseases such as pneumoconiosis, pollinosis, and various allergic diseases when inhaling air mixed with various dust, pollen, ticks and excretions of microorganisms. Various types of dustproof masks have been put on the market for preventing people from being attacked with such diseases.

In conventional ear hanging dustproof masks for covering a mouth and a part of a nose of a wearer or user, there are various types from the simplest mask made of gauze to relatively high performance masks provided with various filters. However, there has not been a substantially conventional dustproof mask which has simultaneously satisfied all three conditions indispensable for the dustproof mask, namely, high dust catching performance, low inhalation resistance and comfortableness when wearing the mask.

SUMMARY OF THE INVENTION

It is an object of the present invention to provide a dustproof mask capable of satisfying the aforementioned three conditions indispensable for the dustproof mask at a reasonable cost by regulating breathing when a user wears the mask and by requiring all inhalation air from open air to pass through a filter.

To achieve the above object, a dustproof mask according to a first aspect of the invention comprises a filter unit 2 disposed inside a mask cover 1 and provided with a baggy filter 5 having an inhalation hole 5*a* in a position corresponding to a mouth of a user, and a boundary plate 3 disposed inside the filter unit 2 and having vent holes 3*a* opposing the inhalation hole 5*a*. A user wears the dustproof mask and exercises breathing in the manner of inhaling open air through the mouth of the user (hereinafter simply referred to as mouth) and exhaling air from the lungs of the user (hereinafter referred to as inner air) through the nostrils of the user (hereinafter simply referred to as nostrils), whereby the user can only take in clean open air which passed through the filter 5.

A dustproof mask according to a second aspect of the invention further comprises a flap-like inhalation check valve 9 disposed in a position of vent holes 3*a* of the boundary plate 3 where the vent holes 3*a* are rendered open only when the user inhales open air through the mouth, in addition to the constituents of the first aspect of the invention. The user wears the dustproof mask and exercises breathing in the manner of inhaling open air through the mouth and exhaling the inner air through the nostrils, whereby the user can only take in clean open air which passed through the filter 5. The inhalation check valve 9 renders the vent holes 3*a* open only when the open air is inhaled through the mouth, thereby preventing exhalation through the mouth. As a result, the inhalation of the open air through the mouth is correctly regulated.

A dustproof mask according to a third aspect of the invention further comprises a flap-like exhalation valve 11 disposed in a position corresponding to the nose for enabling the nostrils to exhale inner air only when the inner air is exhaled through the nostrils, in addition to the constituents of the second aspect of the invention. The user wears the dustproof mask and exercises breathing in the manner of inhaling open air through the mouth and exhaling the inner air through the nostrils, whereby the user can only take in clean open air which passed through the filter 5. The exhalation valve 11 can exhale inner air only when the inner air is exhaled through the nostrils, thereby preventing the inhalation of open air through the nostrils. As a result, the exhalation of air through the nostrils can be correctly regulated.

A filter unit 2 of a dustproof mask according to a fourth aspect of the invention has a spacer 6 inside a baggy filter 5. The spacer 6 has ventilation properties and forms a space inside the baggy filter 5 so as to assure the intake of clean open air at the entire area of the filter 5.

According to the dustproof mask having the constructions set forth above, the user exercises breathing in the manner of inhaling open air through the mouth and exhaling inner air through the nostrils, so that the wearer can only take in clean open air which passed through the filter. As a result, the filter has a very high catching efficiency. Further, the ventilation resistance is lowered owing to a large air intake area for the baggy filter.

Further, the inhalation of the open air through the mouth is correctly regulated owing to the presence of the inhalation check valve. Still further, the exhalation of air through the nostrils is regulated by the exhalation valve. Accordingly, the breathing by the user can be correctly regulated.

Further, since the spacer is inserted into the baggy filter, a space is formed in the filter even if the material of the filter has no rigidity, so that the ventilation resistance of the filter is stabilized for a long period of time.

DETAILED DESCRIPTION OF THE INVENTION

Figure 1:
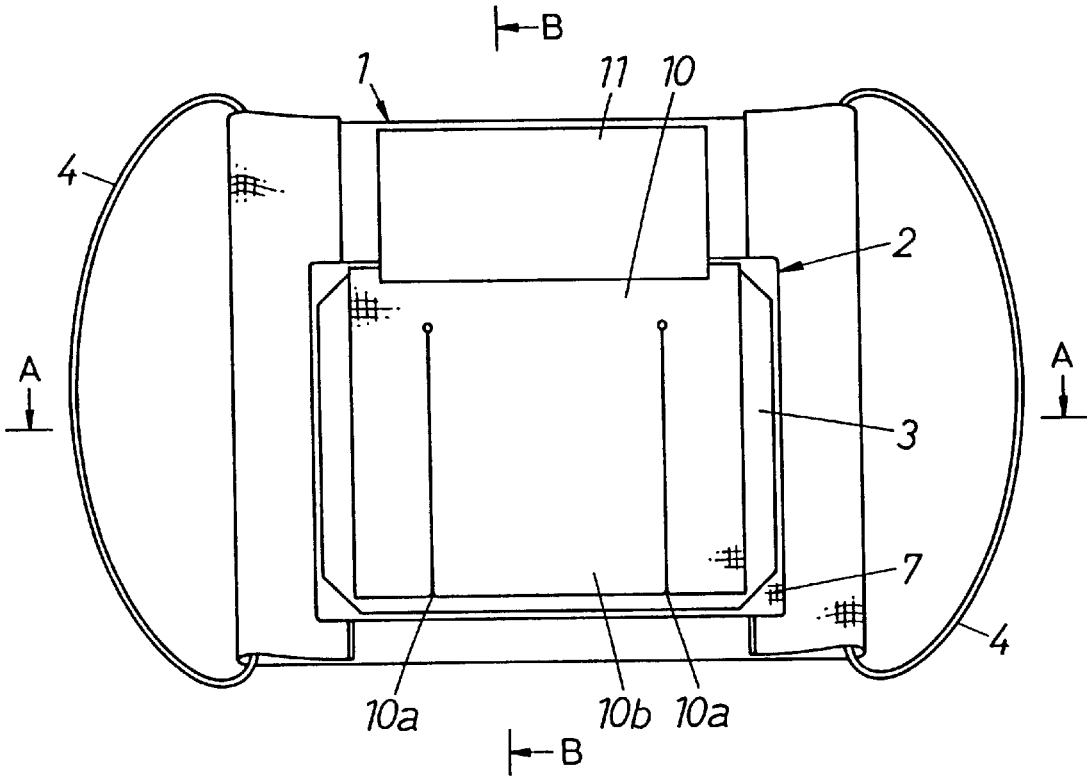
FIG. 1 is a rear view of a dustproof mask as viewed from the inside thereof, namely, from a face side of a user according to a preferred embodiment of the invention.
Figure 2:
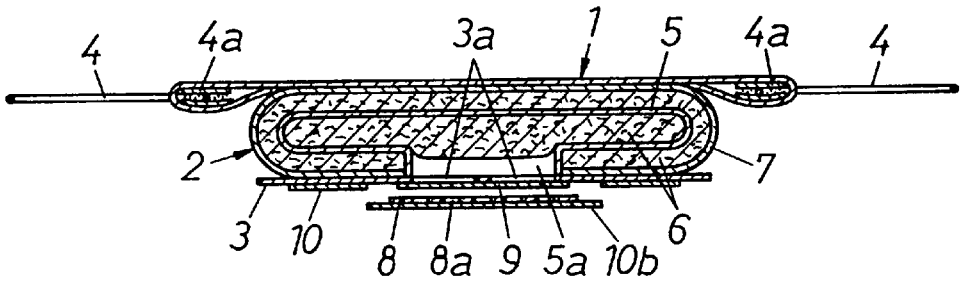
FIG. 2 is a sectional view of the dustproof mask in FIG. 1 taken along the line A—A in the direction of the arrows.
Figure 3:
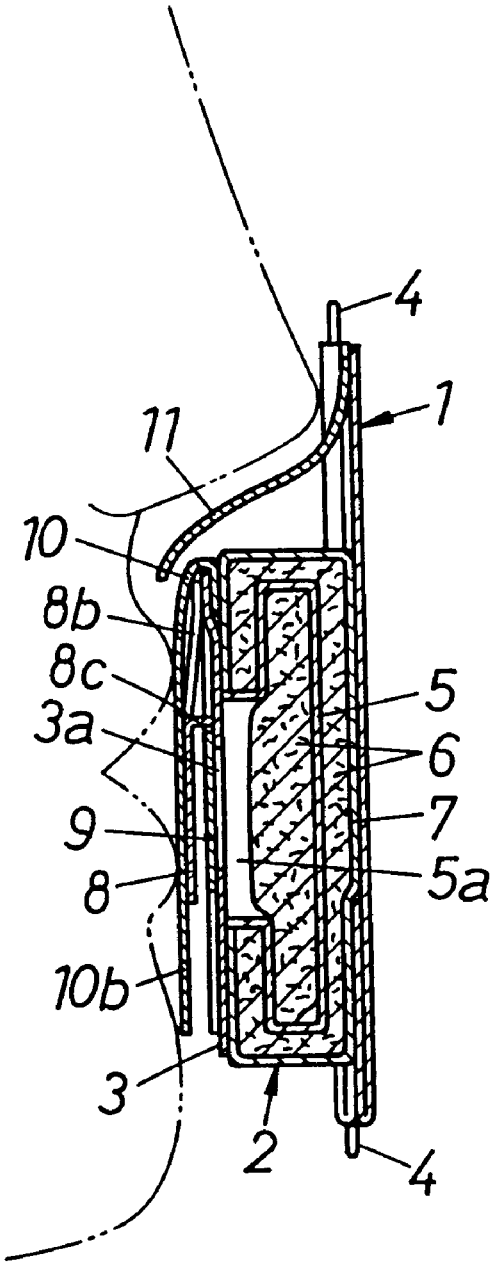
FIG. 3 is a sectional view of the dustproof mask in FIG. 1 taken along the line B—B in the direction of the arrows.
Figure 4:
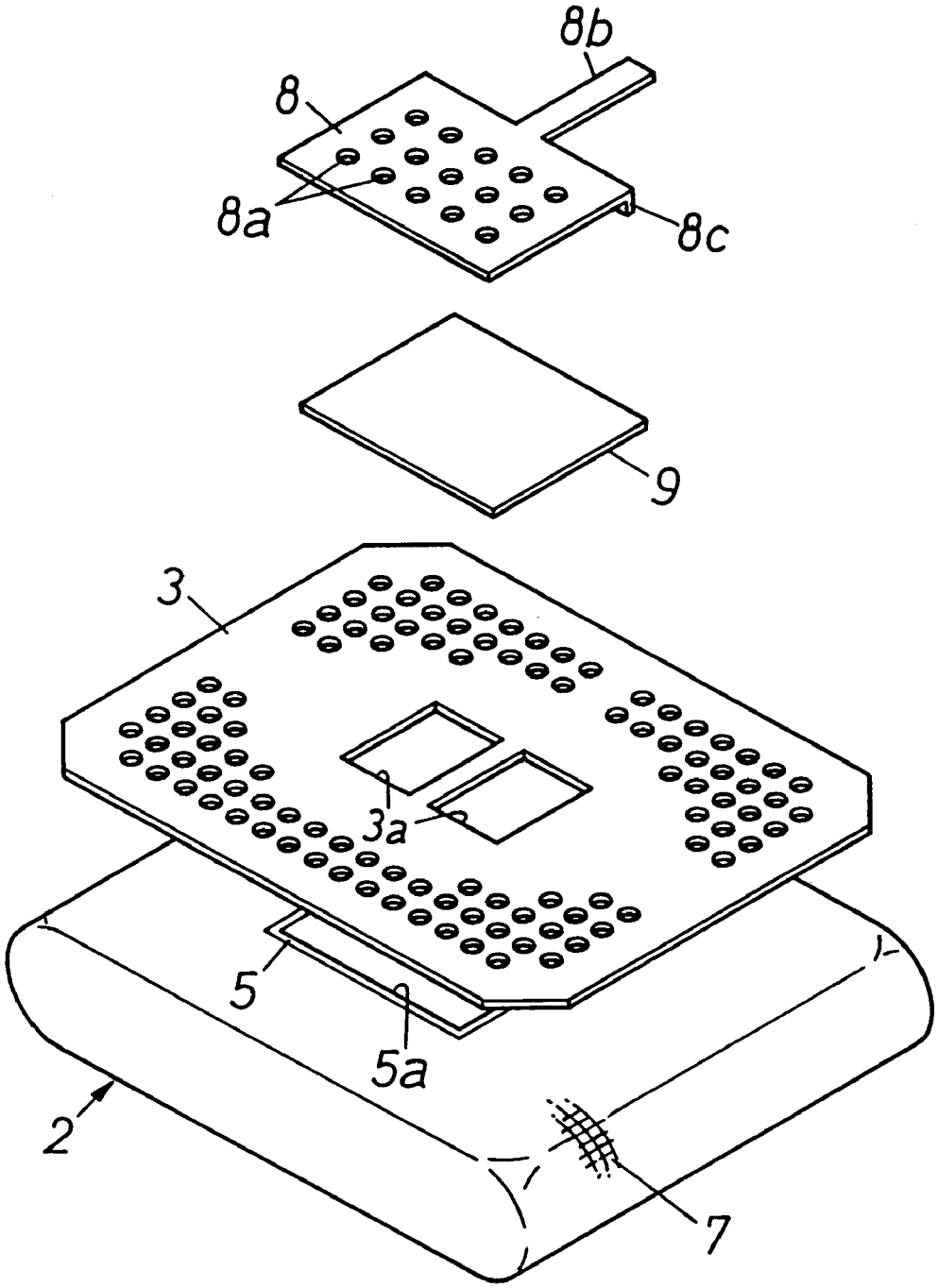
FIG. 4 is an exploded perspective view of the dustproof mask showing the main portion thereof.

A dustproof mask according to a preferred embodiment of the invention will be now described with reference to FIGS. 1 to 4.

In FIGS. 1–4, the dustproof mask comprises a mask cover 1, a filter unit 2, and a boundary plate 3 in this order from an outer surface (open air side) to an inner surface thereof.

The mask cover 1 comprises an antistatic thin cloth made of polyester and having water repellency and high airtightness for preventing dust from sticking thereto. The mask cover 1 has a size and a shape fitted for a user's mouth and nose area by folding back the lower part and right and left sides of a substantially rectangular row cloth inwardly a given width and by temporary bonding thereof. Ear hanging strings 4 are respectively inserted into string holes which are formed by folding back both right and left ends of the mask cover 1, and they are adjustable in a loop length using VELCRO™ hook and loop fastening tapes 4*a* such as MAGIC TAPE™ hook and loop fastening tape (registered trademark) which is fixed to both ends of the ear hanging strings 4.

The back surface of the mask cover 1 is marked appropriately by standard positioning marks of various sizes, not shown, if need be, so that the change of size of the mask cover 1 can be simply adjusted by increasing or decreasing the amount of the mask cover folded.

The filter unit 2 is temporarily bonded to the inner surface of the mask cover 1 by an adhesive cloth or hook and loop fastening tape so as to be detachable from the inner surface of the mask cover 1.

The filter unit 2 incorporates therein a filter 5 made of electret polypropylene unwoven cloth which is charged with static electricity for catching dust, as a main filter element. Since the filter 5 has very high catching efficiency, it is high in the ventilation resistance per unit of area. Hence the filter 5 is formed of a flat baggy construction to reduce the ventilation resistance as a whole, and has a large surface for forming an air intake surface. The open portion of the baggy filter 5 forms an inhalation hole 5*a*, and it is disposed inside the filter unit 2 and is formed in the central portion corresponding to the mouth.

A spacer 6 is normally attached to at least an inner portion, namely, an inner surface of the baggy filter 5 and an outer surface of the filter 5, as needed, so as to form a space through which air moves freely at both surfaces of the filter 5. The spacer 6 is made of an aggregation of particles of activated charcoal, a polyester cotton, a sponge, a laminated net body, or a woven texture or unwoven texture. The spacer 6 may contain deodorant, perfume, or absorbent in compliance with the use of the dustproof mask. As a matter of course, the spacer 6 may be dispensed with if the baggy filter 5 has a space therein owing to its rigidity. The filter 5 and the spacer 6 are respectively covered with a filter unit cover 7 which is made of a high ventilation sheet, for example, a nylon unwoven cloth or antibacterial chitin-chitosan sheet.

The boundary plate 3 is formed of a thin soft waterproof sheet, for example, PET (polyethylene terephthalate), PE (polyethylene), PVC (polyvinyl chloride), PS (polystyrene), raw biodegradable plastic, paper, etc. The boundary plate 3 has one or two or more vent holes 3*a* at the center thereof. The boundary plate 3 is fixed to the inhalation hole 5*a* of the baggy filter 5 at the peripheral edge of the vent holes 3*a*. As a result, the inside of the baggy filter 5 communicates with the vent holes 3*a* of the boundary plate 3 through the inhalation hole 5*a*.

Further, if needed, a rectangular inhalation check valve cover 8 is provided in the areas of the vent holes 3*a*. The inhalation check valve cover 8 is normally formed of the same material as the boundary plate 3, and has a plurality of small holes 8*a*. The inhalation check valve cover 8 is fixed to the inner side surface of the boundary plate 3 by a fixed portion 8*b* which protrudes upward. Since a contact piece 8*c*, which is bent at right angles at the upper side of the inhalation check valve cover 8, strikes against the surface of the boundary plate 3, the inhalation check valve cover 8 and the boundary plate 3 form a space therebetween. The space incorporates therein a flap-like inhalation check valve 9, and permits the movement of the inhalation check valve 9 therein.

The flap-like inhalation check valve 9 is positioned in a space between the boundary plate 3 and the inhalation check valve cover 8 and is provided at the vent holes 3*a*, so that the inhalation check valve only renders the vent holes 3*a* open in compliance with the inhalation of the open air through the mouth. The inhalation check valve 9 is substantially the same shape as the inhalation check valve cover 8 and is formed of a very thin soft resin sheet. Since the inhalation check valve 9 is fixed by adhesion to the upper portion of the vent holes 3*a* of the boundary plate 3 at the upper edge thereof, the check valve normally closes the vent holes 3*a* in a space between the inhalation check valve cover 8 and the boundary plate 3, but is moved away from the vent holes 3*a* in compliance with the inhalation of open air through the mouth to render the vent holes 3*a* open.

A plate cover 10 is detachably secured on the inner side surface of the boundary plate 3 to enhance the contact feeling relative to skin around the mouth of a wearer. The plate cover 10 does not impede the airtightness between the mouth and the boundary plate 3, and is formed of a very thin gauze having high absorbency and ventilation properties. Further, the plate cover 10 has a pair of right and left slits 10*a* in a vertical direction thereof. The pair of slits 10*a* form a free flap portion 10*b* at the position corresponding to the inhalation check valve cover 8, so as to confirm the position of the inhalation check valve cover 8 by the wearer's lips. The plate cover 10 can be reused by removing and washing it when it is smudged.

Further, if needed, an exhalation valve 11 is provided inside the mask cover 1 at the position corresponding to the nose of a wearer. The exhalation valve 11 is made of a soft resin sheet and the exhalation valve 11 is detachably fixed to the inner side surface of the mask cover 1 at the upper edge thereof by the hook and loop fastening tape, etc. The exhalation valve 11 is always moved away from the nostrils to enable the nostrils to exhale inner air, and inhibits the inhalation of air through the nostrils by closing the nostrils when attempting to inhale air through the nostrils.

As mentioned above, since the user's mouth is brought into intimate contact with the outer periphery of the vent holes 3*a* of the boundary plate 3, only the inside of the mouth communicates with the inner surface of the filter 5 through the vent holes 3*a* and the inhalation holes 5*a* once the user opens his mouth. As a result, only the pure air that passes through the filter 5 is inhaled into the user's mouth. Then, since the user's nostrils are only used for exhaling the inner air, the nostrils can be opened in a state communicating with the open air. Accordingly, the mask cover 1 need not cover the nose so long as the user does not inhale through the nose.

Although the preferred embodiment, as set forth above, merely exemplifies one dustproof mask, the constituents of the dustproof mask can be changed, and combinations thereof, without departing from the gist of the invention in compliance with the use thereof.

A plurality of filter units 2 may be provided in compliance with the use of the dustproof mask. Bellow like folding wrinkles may be provided on the filter 5, or irregularities are provided on the filter 5 to increase the surface area, or antibacterial, deodorizing, antiallergic drugs are impregnated in the filter 5 or the spacer 6, thereby adding specific functions.

A user wears the mask cover 1 on the face using the pair of ear hanging strings 4 so as to cover the mouth and nose areas with the mask cover 1. Thereafter the mouth is directed toward and put on the inhalation hole 5*a* of the filter unit 2 so as to execute breathing by inhaling the open air through the mouth and by exhaling the inner air through the nose. To obtain such a result, the open air passes through the inside of the filter 5 from the outside thereof, and enters the filter 5 and reaches the mouth through the inhalation hole 5*a* and the vent holes 3*a*. When breathing, the purified open air is inhaled through the mouth owing to the high catching performance of the filter 5, and then the inner air is exhaled through the nose, thereby enhancing the filtration efficiency and preventing symptoms such as sneezing, mucus, and nasal congestion, which are caused by pollen or a stimulus of cold open air.

The ventilation resistance of the filter 5, per unit area, increases due to the high catching performance of the filter 5. However, since the filter 5 is baggy and has a large surface area for forming an air intake surface, the ventilation resistance is lowered as a whole. As a result, a high dust catching efficiency is attained with low ventilation resistance, irrespective of a limited mouth area of the face. At the same time, the airtightness between the mouth and the boundary plate 3 is assured due to the presence of moderate low ventilation resistance. As a result, only clean air passes through the filter 5, and is inhaled through the mouth.

The spacer 6 having the ventilation property is inserted at least into the inner portion of the baggy filter 5. The spacer 6 is not brought into contact with the inner portion of the filter 5 due to the negative pressure at the inner side surface of the filter 5. Thus the ventilation resistance is stabilized for a long period of time. If the spacer 6 is provided on the outer surface of the filter 5, open air can be taken in the filter 5 from the front surface thereof even if the mask cover 1 has no ventilation property.

When the user exercises the aforementioned breathing, the inhalation check valve 9 renders the vent holes 3*a* open in compliance with the inhalation of the open air though the mouth, thereby preventing the exhalation of air through the mouth. Accordingly, the inhalation of the open air through the mouth can be correctly regulated. When the motion of the inhalation check valve 9 is confirmed, the airtightness between the mouth and the surface of the boundary plate 3 is simply decided when inhaling the open air.

The exhalation valve 11 is always moved away from the nostril to enable the nostrils to exhale the inner air, otherwise the exhalation valve prevents the inhalation of air through the nostrils. Accordingly, the exhalation of air through the nostrils can be correctly regulated. Accordingly, it is possible to very easily transfer from the ordinary natural breathing which is concentrated through the nose portion to the specific breathing through the mouth.

The dustproof mask can be worn comfortably and does not become stuffy due to the presence of the plate cover 10. Further, since the plate cover 10 can be easily purified, if need be, the dustproof mask can be kept clean for a long period of time.

Still further, the mask cover 1 can be folded back and temporarily bonded according to the preferred embodiment of the invention. The mask cover 1 has the size and shape to fit the mouth and nose areas. Further, the right and left ear hanging strings 4 can be adjusted to its loop length. Accordingly, the dustproof mask can be utilized having an appropriate size and shape in compliance with the use thereof.

What is claimed is:

1. A dustproof mask comprising:

a cloth mask cover;

a filter unit disposed inside the mask cover and provided with a flat baggy filter having an inhalation hole at a position corresponding to a mouth of a user and defining a space therein; and a soft boundary plate disposed adjacent the filter unit and having vent holes that communicate with the inhalation hole and oppose the mouth of the user such that, during inhalation, airtightness is formed between the mouth of the user and a surface of the boundary plate;

wherein the dustproof mask regulates breathing of the user in a manner of inhaling open air through the mouth and of exhaling inner air through nostrils of the user.

2. The dustproof mask according to claim 1, and further comprising:

a flap-like exhalation valve disposed in a position corresponding to a nose of the user and always moved away from nostrils of the user to enable the nostrils to exhale inner air while preventing inhalation of open air through the nostrils.

3. The dustproof mask according to claim 2, wherein the filter unit is structured by inserting a spacer having ventilation property into the baggy filter.

4. A dustproof mask comprising:

a cloth mask cover;

a filter unit disposed inside the mask cover and provided with a baggy filter having an inhalation hole at a position corresponding to a mouth of a user;

a boundary plate disposed adjacent the filter unit and having vent holes opposing the inhalation hole; and a flap-like inhalation check valve disposed in positions adjacent the vent holes of the boundary plate where the vent holes are rendered open only when the user inhales open air through the mouth;

wherein the dustproof mask regulates breathing of the user in a manner of inhaling open air through the mouth and requiring exhaling of inner air through nostrils of a user.

5. The dustproof mask according to any of claims 1, 2 and 4, wherein the filter unit is structured by inserting a spacer having ventilation property into the baggy filter.

6. The dustproof mask according to claim 4, wherein the filter unit is structured by inserting a spacer having ventilation property into the baggy filter.

7. A mask comprising:

a mask cover;

a filter unit disposed inside the mask cover and provided with a filter at a position corresponding to a mouth of a user;

an inhalation check valve, the inhalation check valve opening only when the user inhales open air through the mouth; and an exhalation valve disposed in contact with nostrils of the user during an attempt to inhale open air through the nostrils, the exhalation valve thereby preventing the inhalation of open air through the nostrils, the exhalation valve moving away from the nostrils of the user during the exhalation of inner air from the nostrils.

8. The dustproof mask according to claim 7, the exhalation valve comprising a sheet secured to an inner side surface of the mask cover.

9. The dustproof mask according to claim 7, the filter unit having an inhalation hole at a position corresponding to the mouth of the user, the mask including a boundary plate disposed adjacent the filter unit and having vent holes that communicate with the inhalation hole, the boundary plate opposing the mouth of the user such that, during inhalation, airtightness is formed between the mouth of the user and a surface of the boundary plate.

10. The dustproof mask according to claim 7, wherein the mask cover comprises a thin cloth.

11. The dustproof mask according to claim 7, wherein the filter is flat and baggy.

12. The dustproof mask according to claim 11, wherein a spacer is attached to an inner surface of the flat baggy filter.

13. The dustproof mask according to claim 7, wherein the mask includes a boundary plate including vent holes and comprising a waterproof sheet disposed adjacent the filter unit.

14. The dustproof mask according to claim 13, wherein the boundary plate communicates with an inhalation hole of the filter and opposes the mouth of the user.

15. The dustproof mask according to claim 7, wherein the filter unit comprises one of a plurality of filter units.

16. The dustproof mask according to claim 7, wherein drugs are impregnated into the filter.

* * * * *

UNITED STATES PATENT AND TRADEMARK OFFICE

CERTIFICATE OF CORRECTION

PATENT NO : 5 941 244

DATED : August 24, 1999

INVENTOR(S) : Tomohiro YAMAZAKI et al

It is certified that error appears in the above-identified patent and that said Letters Patent is hereby corrected as shown below:

Column 6, line 42;

delete "any of claims 1, 2, and".

Column 6, line 43;

change "4" to ---claim 1---.

Signed and Sealed this

Sixth Day of June, 2000

*Attest:*

*Attesting Officer*

Q. TODD DICKINSON

*Director of Patents and Trademarks*